US006340055B1

(12) United States Patent
Yamauchi et al.

(10) Patent No.: US 6,340,055 B1
(45) Date of Patent: Jan. 22, 2002

(54) HEAT EXCHANGER HAVING MULTI-HOLE STRUCTURED TUBE

(75) Inventors: Yoshiyuki Yamauchi, Chita-gun; Ken Yamamoto, Obu; Osamu Kobayashi; Minoru Ohta, both of Chiryu; Toshiya Nagasawa, Obu, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/578,930

(22) Filed: May 25, 2000

(30) Foreign Application Priority Data

May 25, 1999 (JP) ..... 11-145323

(51) Int. Cl.[7] ..... F28F 9/02
(52) U.S. Cl. ..... 165/174; 165/153; 165/175
(58) Field of Search ..... 165/153, 173, 165/175, 178, 177, 174; 29/890.045, 890.053

(56) References Cited

FOREIGN PATENT DOCUMENTS

JP A-11-351783 12/1999

*Primary Examiner*—Henry Bennett
*Assistant Examiner*—Terrell McKinnon
(74) *Attorney, Agent, or Firm*—Harness, Dickey & Pierce, PLC

(57) ABSTRACT

A tube for a heat exchanger has notch portions at a longitudinal direction end portion to be inserted into a header tank. Further, several passage holes are provided in the tube to extend in a longitudinal direction of the tube in which refrigerant flows. The notch portions are formed by cutting parts of the tube to be defined by cut surfaces. The passage holes are not provided at portions corresponding to the cut surfaces. Therefore, the passage holes are securely prevented from being crushed and cut when the notch portions are formed by cutting. As a result, joining failure between the tube and the header tank can be prevented.

20 Claims, 11 Drawing Sheets

HEAT EXCHANGER HAVING MULTI-HOLE STRUCTURED TUBE

CROSS REFERENCE TO RELATED APPLICATION

This application is based upon and claims the benefit of Japanese Patent Applications No. 11-145323 filed on May 25, 1999, the contents of which are incorporated herein by reference.

BACKGROUND OF THE INVENTION

1. Field of the Invention

This invention relates to heat exchangers suitable for a radiator, an evaporator, or the like in a refrigerating cycle.

2. Description of the Related Art

JP-A-1-351783 proposes a heat exchanger in which, as shown in FIG. 15A, notch portions 211*a* indicated with slant lines are provided at both long-side end portions of a tube 211 to reduce a size of the heat exchanger in a direction parallel to an air flow direction.

On the other hand, as shown in FIG. 15B, a tube 211, which is generally used at a high internal pressure state for a heat exchanger such as a condensers a radiator, or a heat exchanger of a super critical refrigerating cycle, adopts a multi-hole structure having several passage holes 211*b* arranged in the cross-sectional long-side direction thereof, thereby improving a withstand pressure of the tube 211. The super critical refrigerating cycle uses refrigerant such as carbon dioxide, ethylene, ethane, or nitrogen oxide, a pressure of which exceeds a super critical pressure.

SUMMARY OF THE INVENTION

However, it has been revealed by the inventors that the following problems were liable to occur when the structure proposed in JP-A-11-351783 was applied to the tube 211 having the multi-hole structure. Specifically, the passage holes 211*b* are formed at the same time when the tube 211 is formed by extrusion molding or the like. If the notch portions 211*a* are formed on the tube 211 by cutting after the passage holes 211*b* are formed, as shown in FIG. 16A, the cut surface is liable to be crushed at a vicinal region of the passage holes 211*b*. When the cut surface is crushed to form a crushed portion 160 and the tube 211 is inserted into a header tank with the crushed portion 160, the crushed portion 160 forms a space between the tube 211 and the header tank, and the space induces joining failure (welding failure) therebetween readily. Further, if the tube 211 has manufacture variations when it is formed and it is cut, as shown in FIG. 16B, one of the passage holes 211*b* may be cut. The cut hole 211*b* forms a space (gap), which can induce the joining failure between the tube 211 and the header tank readily.

The present invention has been made in view of the above problems. An object of the present invention is to prevent joining failure between a multi-hole structured tube and a header tank in a heat exchanger.

According to the present invention, a tube for a heat exchanger has an end portion in a longitudinal direction thereof. The end portion is formed by a cut surface, which extends in the longitudinal direction of the tube and defines an end portion width, which is smaller than a tube width at a portion of the tube other than the end portion. The end portion width and the tube width are perpendicular to the longitudinal direction and parallel to a cross-sectional long side direction of the tube. The tube has a plurality of passage holes arranged in the cross-sectional long side direction within the end portion width, and a hole of the passage holes disposed most adjacently to the cut surface defines a specific distance $\delta_0$ from the cut surface.

Accordingly, the hole and the cut surface can be prevented from being crushed when the cut surface is formed. When the end portion of the tube is inserted into a header tank, no gap is produced between the tube and the header tank, thereby preventing joining failure between the tube and the header tank.

BRIEF DESCRIPTION OF THE DRAWINGS

Other objects and features of the present invention will become more readily apparent from a better understanding of the preferred embodiments described below with reference to the following drawings, in which.

DETAILED DESCRIPTION OF THE PREFERRED EMBODIMENTS (First Embodiment)

In a first preferred embodiment of the present invention, a heat exchanger according to the present invention is adopted to an evaporator 100 of a super critical refrigerating cycle using carbon dioxide as refrigerant.

Figure 1:
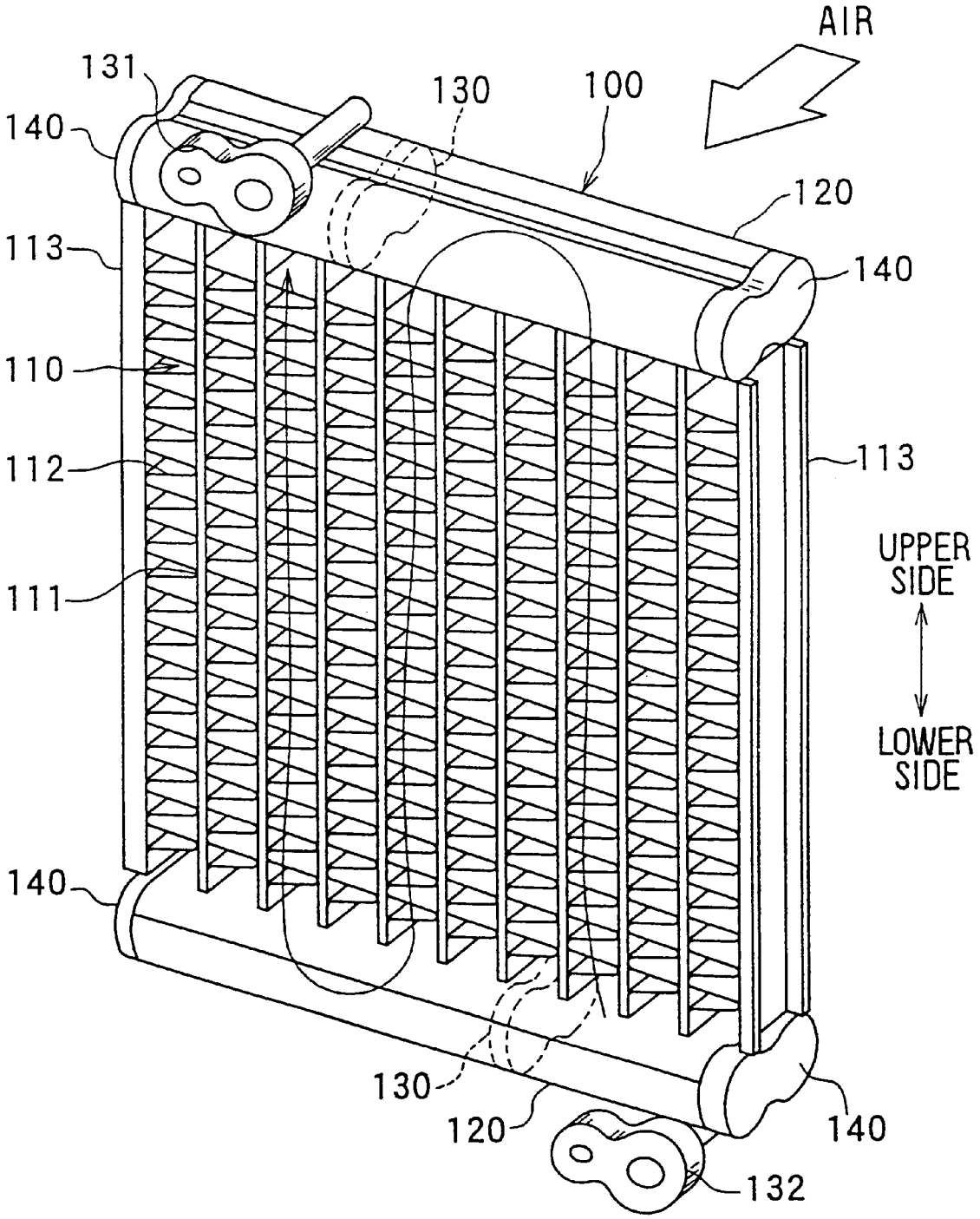
FIG. 1 is a perspective view showing a heat exchanger in a first preferred embodiment of the present invention.

Referring to FIG. 1, the evaporator 100 has several flat tubes 111 extending in a vertical direction in which refrigerant (fluid) flows. The tubes 111 are formed from aluminum members by extrusion molding. Aluminum corrugated fins 112 are respectively disposed between and joined to adjacent two of the tubes 111, thereby increasing a radiation area for facilitating heat exchange between refrigerant and air. Both front and back surfaces of each of the corrugated fins 112 are clad with brazing filler metal. The fins 112 and the tubers 111 are integrated with one another by brazing, thereby forming a core portion 110 of the evaporator 100.

Side plates 113 for reinforcement are brazed to the fins 112 by the brazing filler metal coated on the fins 112 at both ends of the core portion 110 in a lamination direction of the tubes 111. Header tanks (herebelow, referred to as header) 120 are joined to the tubes 111 at upper and lower ends in the longitudinal direction of the tubes 111. The headers 120 extend in a direction perpendicular to the longitudinal direction of the tube 111 and communicate with the respective tubes 111. In FIG. 1, the lower side header 120 is to distribute refrigerant into the respective tubes 111, and the upper side header 120 is to collect refrigerant discharged from the tubes 111. The evaporator 100 has two joint blocks 131, 132. The joint block 131 is connected to a pressure reducing valve side (not shown), and the joint block 132 is connected to a compressor side (not shown) in the super critical refrigerating cycle.

Figure 2:
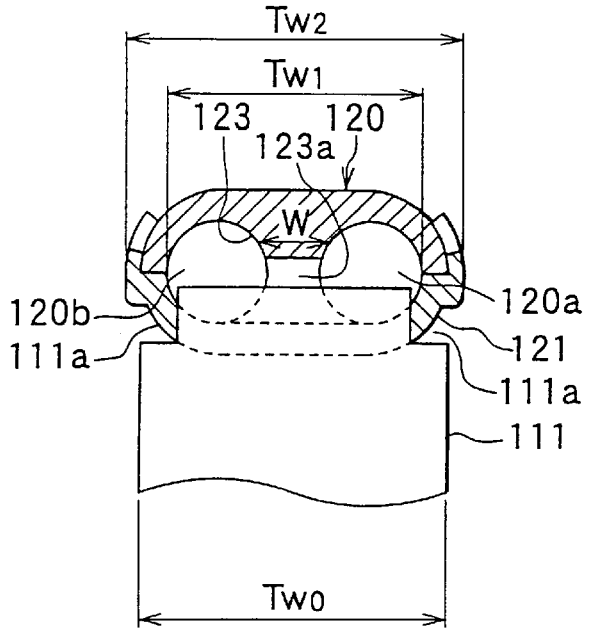
FIG. 2 is a cross-sectional view showing a joining portion between a header and a tube in the first embodiment.
Figure 3:
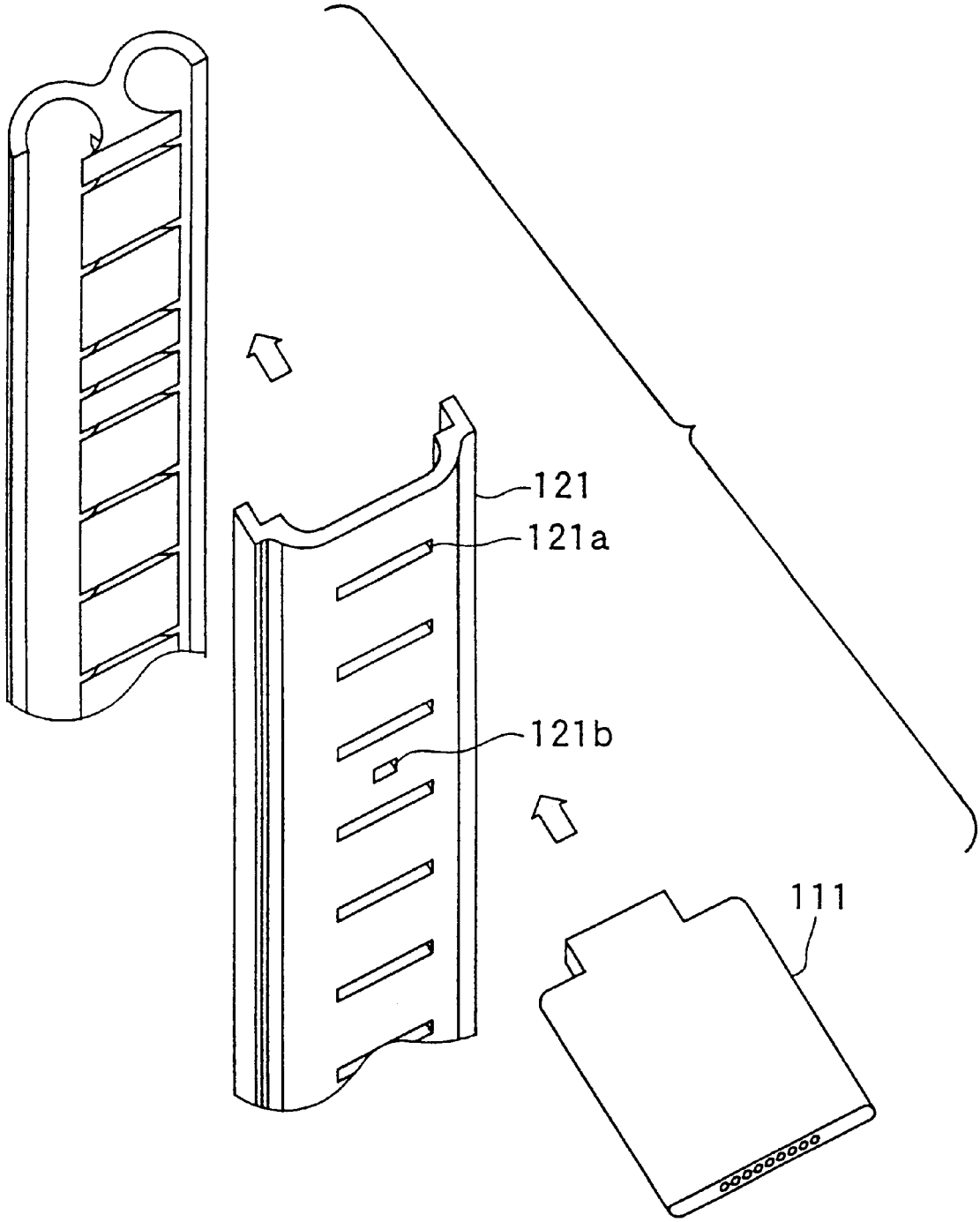
FIG. 3 is an exploded perspective view showing the header and the tube.

As shown in FIGS. 2 and 3, each of the headers 120 is composed of a first plate 121 having first insertion holes 121*a* into which the flat tubes 111 are respectively inserted, and a second plate 122 joined to the first plate 121 to form a passage in which refrigerant flows. The second plate 122 integrally has an inner pillar member 123, which extends in the longitudinal direction of the header 120 and protrudes toward the side of the first plate 121. A front end portion of the inner pillar member 123 is joined to the inner wall of the first plate 121, so that the inner walls of the plates 121 and 122 are connected to each other via the inner pillar member 123. The inner pillar member 123 divides the inner space of the tube 120 into first and second spaces 120*a* and 120*b*, respectively extending in the longitudinal direction of the header 120.

In the present embodiment, the front end portion of the inner pillar member 123 at a side of the first plate 1221 is partially cut by milling, thereby forming communication passages 123*a*. The communication passages 123*a* are, as shown in FIG. 2, provided correspondingly to the first insertion holes 121*a*. The inner pillar member 123 has across-section, a width W of which increases as it approaches either one of the inner walls of the plates 121 and 122. The cross-section of the inner pillar member 123 is arched so that each of the spaces 120*a* and 120*b* has a generally circular cross-section. The width W of the inner pillar member 123 is a dimension in a direction parallel to a longer radial direction of the flat (elliptic) header 120.

The first plate 121 is formed from an aluminum member (A3003 system) by pressing, and the second plate 122 is formed from an aluminum member (A3003 system) by extrusion. Front and back surfaces of each of the plates 121, 122 are clad with brazing filler metal, and the plates 121, 122 having the inner pillar member 123, the tubes 111, and the side plates 113 are integrally brazed to one another by the brazing filler metal.

Figure 4:
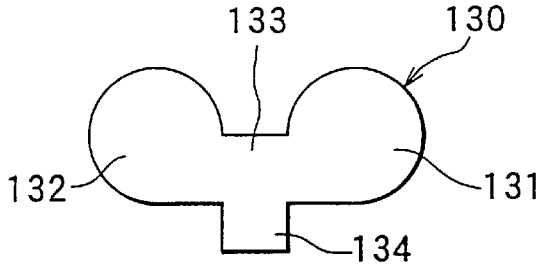
FIG. 4 is a front view showing a separator.

Referring back to FIG. 1, a separator 130 is disposed within the header 120 to divide the first and second spaces 120*a*, 120*b* into several spaces in the longitudinal direction of the header 120. Refrigerant flows in the core portion 110 with an S-like shape due to the separator 130. As shown in FIG. 4, the separator 130 is composed of first and second disk portions 131, 132, a connecting portion 133 connecting the disk portions 131, 132 therebetween, and a protruding portion 134 protruding from the connecting portion 133 toward the side of the first plate 121. The portions 131–134 are integrally formed from an A3003 system aluminum plate member by pressing.

On the other hand, as shown in FIG. 3, the first plate 121 has a second insertion hole 121*b* for receiving the protruding portion 134 therein. The separator 130 is brazed to the inner walls of the plates 121, 122 and the inner pillar member 123 in the sate where the protruding portion 134 is inserted into the second insertion hole 121*b*.

Figure 5:
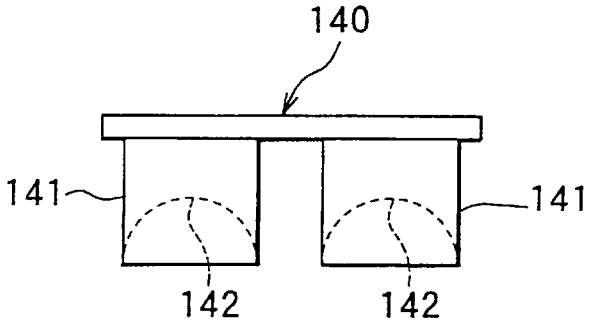
FIG. 5 is a front view showing a cap.

Referring back again to FIG. 1, aluminum header caps 140 are brazed to the header 120 to close respective ends of the first and second spaces 120*a*, 120*b* in the longitudinal direction of the header 120. As shown in FIG. 5, each of the caps 140 has columnar protruding portions 141 for being inserted into the first and second spaces 120*a*, 120*b*, and each protruding portion 141 has a generally spherical surface portion 142 at a front end thereof. The caps 140 are also brazed to the header 120 (both the plates 121, 122) by brazing filler metal sprayed on the caps 140.

Next, the structure of the tube 111 will be explained below.

Figure 6A:
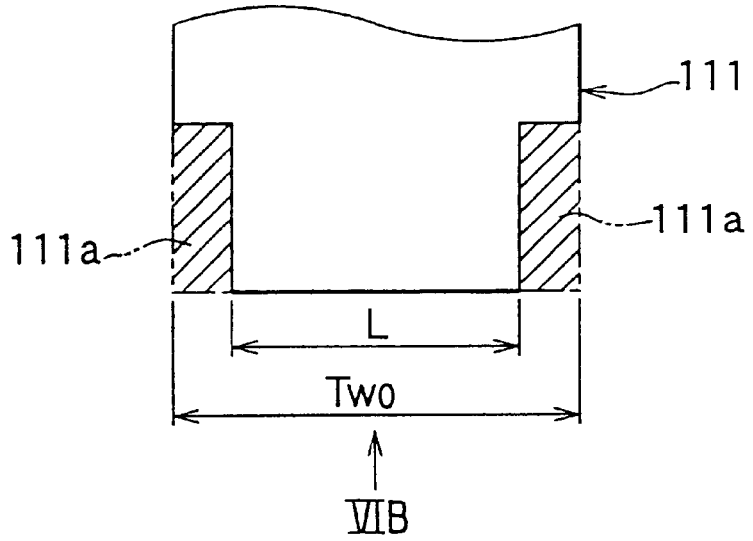
FIG. 6A is a front view showing a longitudinal direction end portion of the tube in the first embodiment.

As shown in FIG. 2, the tubes 111 has a maximum cross-sectional long side dimension (tube width $T_{W0}$), which is larger than inner wall width $T_{W1}$ and is equal to or smaller than outer wall width $T_{W2}$ of the header 120. As shown in FIG. 6A, the tube 111 has a longitudinal end portion, both cross-sectional long side ends of which are cut to form notch portions 111*a* as indicated by slant lines in the figure, and the longitudinal end portion is inserted into the header 120.

Incidentally, the inner wall width $T_{W1}$ of the header 120 is a maximum dimension defined by the inner wall of the header 120 in a direction parallel to the cross-sectional long side of the tube 111, i.e., parallel to an air flow direction. The outer wall width $T_{W2}$ of the header 120 is a maximum dimension defined by the outer wall of the header in the direction parallel to the cross-sectional long side of the tube 111, i.e., parallel to the air flow direction.

Figure 6B:
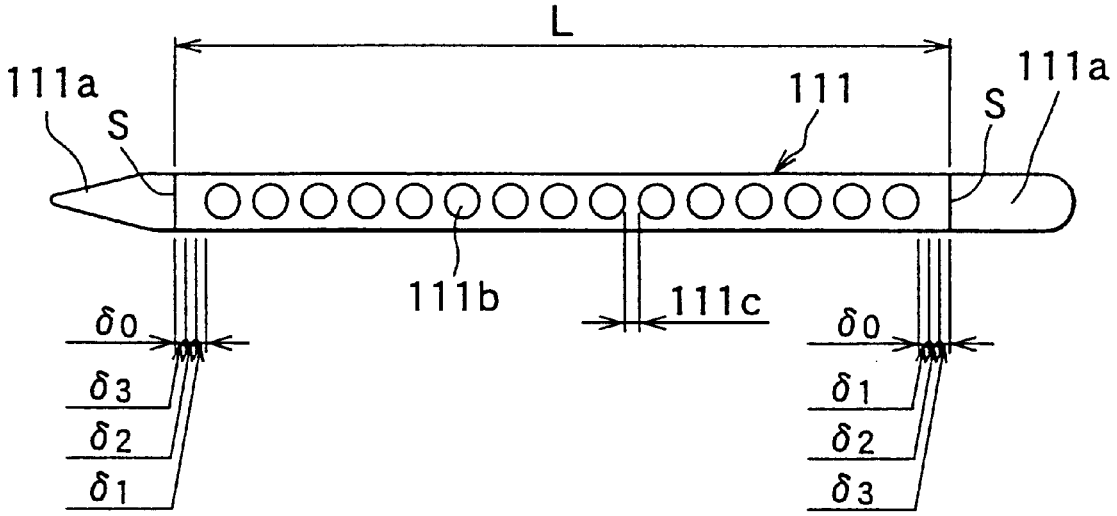
FIG. 6B is a plan view showing the longitudinal direction end portion of the tube in a direction indicated by arrow VIB in FIG. 6A.

On the other hand, as shown in FIG. 6B, several passage holes 111*b* each having a circular shape in cross-section are provided in the tube 111 to extend in the longitudinal direction of the tube 111. The passage holes 111*b* are arranged in the cross-sectional long side direction of the tube 111 within a dimension (end portion width) L, which is smaller than the inner wall width $T_{W1}$ of the header 120. The dimension L is a dimension of a portion of the tube 111, which is to be inserted into the first insertion hole 121*a*. Therefore, the dimension L is determined in consideration of manufacture tolerances (variations) of the tube 111, the first plate 121, the first insertion hole 121*a*, and the notch portions 111*a*.

A distance $\delta_0$ between one of the passage holes 111*b* disposed at the end in the long side direction of the tube 11 and the cut surfaces S of one of the notch portions 111*a* is the sum of dimensions $\delta_1$, $\delta_2$, and $\delta_3$. The dimension $\delta_1$ is a dimension required for preventing the passage holes 111*b* from being crushed when the notch portions 111*a* are formed, i.e., when the both ends of the tubes 111 are removed by cutting to form the notch portions 111*a*. The dimension $\delta_2$ is a dimensional tolerance between two passage holes 111*b*, i.e., a positional tolerance of a pillar portion having a length 111*c* and provided between the two passage holes 111*b*. The dimension $\delta_3$ is a positional cut tolerance (positional variation amount) of the cut surfaces S. Incidentally, the length 111*c* is a pitch of the passage holes 111*b*, and the distance $\delta_0$ is larger than the pitch 111*c*.

Figure 7:
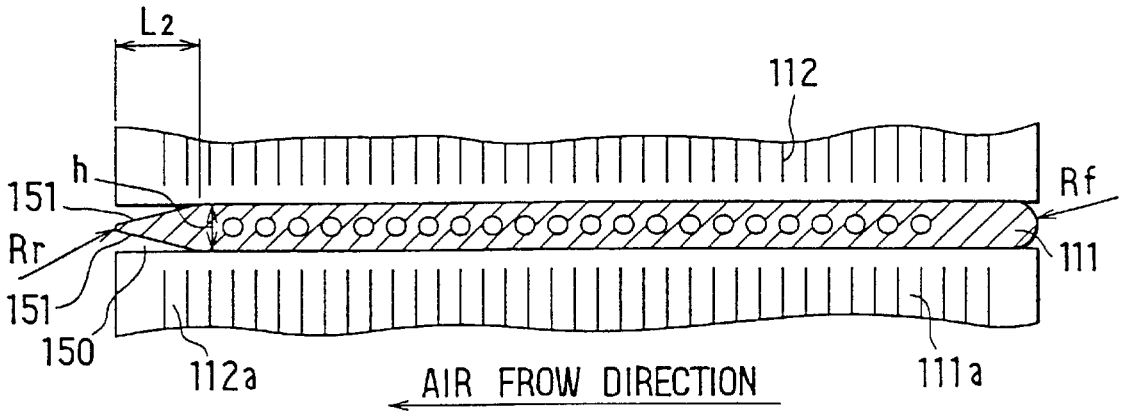
FIG. 7 is a cross-sectional view showing a core portion of the heat exchanger in the first embodiment.

As shown in FIG. 7, one of the cross-sectional long side ends of the tube 111, which is disposed at the air flow downstream side, is tapered as a tapered portion 151, a thickness of which is decreased as it approaches the front end (air flow downstream side) thereof. Accordingly, the tapered portion 151 of the tube 111 forms gaps 150 at both sides thereof with the fins 112 not to contact the fins 112.

Because of this, the cross-sectional long side end of the tube 111 at the air flow downstream side has a curve Rr, which is smaller than a curve Rf at the air flow upstream side. Each of the gaps 150 has a dimension L2 parallel to the cross-sectional long side direction of the tube 111, and the dimension L2 is larger than a half (=Rf) of the thickness h of the tube 111. The thickness h of the tube 111 is a length of the tube in a cross-sectional short side direction of the tube 111, and is approximately twice of the curve Rf at the air flow upstream side in the present embodiment. Incidentally, in FIG. 7, reference numerals 112*a* denotes louvers, which hare formed by partially cutting and bending the fin 112 to prevent a temperature boundary layer from being produced between the fin 112 and air.

Next, features of the present invention will be explained below.

The passage holes 111*b* are arranged in the cross-sectional long-side direction within the dimension L, which is smaller than the inner wall width $T_{W1}$ of the header 120. Therefore, the tube 111 of the present embodiment has portions corresponding to the notch portions 111*a* where no passage holes 111*b* are formed at the cross-sectional long side end portions. The passage holes 111*b* are prevented from being provided in the vicinity of the cut surfaces S.

Therefore, when the cross-sectional long side end portions of the tube 111 are removed by cutting to form the notch portions 111*a*, the cut surfaces S are prevented form being crushed or sagged. In addition, the passage holes 111*b* are securely prevented from being cut when the notch portions 111*a* are formed. As a result, when the tube 111 is inserted into the first insertion hole 121*a*, no gap is produced between the tube 111 and the first plate 121. Therefore, joining failure (welding failure) does not occur between the tube 111 and the header 120.

Thus, according to the present embodiment, the joining failure (welding failure) is prevented from occurring between the tube 111 and the header 120 while preventing an increase in manufacture cost of the tube 111 (evaporator 100). In addition, the tube 111 has the notch portions 111*a*. Therefore, the effects described above can be achieved while maintaining a sufficient heat exchange capacity of the evaporator 100.

As described above referring to FIG. 7, the gaps 150 are formed at the cross-sectional long side and air flow downstream side end of the tube 111. Condensed water condensed on the surfaces of the fin 112 and the tube 111 gathers in the gaps 150 by a surface tension thereof (capillary phenomenon by the gaps 150) and flows downwardly along the tube 111. As a result, the drainage property of condensed water is improved. Further, because the thickness of the tapered portion 151 is decreased as it approaches the front end thereof at the air flow downstream side, each of the gaps 150 has a wedge shape sharpened with an acute angle at the air flow upstream side thereof. This makes it secure to gather and drain condensed water.

Figure 8:
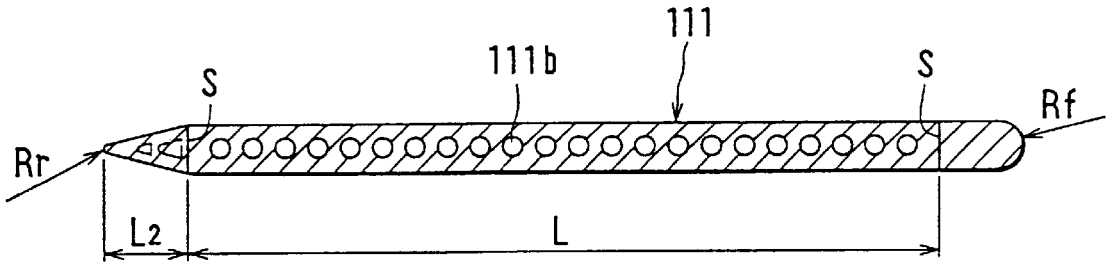
FIG. 8 is a cross-sectional view showing a core portion of a heat exchanger as a comparative example.

When the passage holes 111*b* are formed entirely in the cross-sectional long side direction of the tube 111 as a conventional manner, as shown in FIG. 8, some of the passage holes 111*b* provided at the tapered portion 151 are crushed. Because of this, teeth used at the extrusion processing of the tube 111 are thinned to be broken readily. As opposed to this, according to the present embodiment, any of the passage holes 111*b* are not formed at the tapered portion 151. Therefore, the teeth used at the extrusion processing need not be thinned, thereby preventing the damage to the teeth.

(Second Embodiment)

Figure 9A:
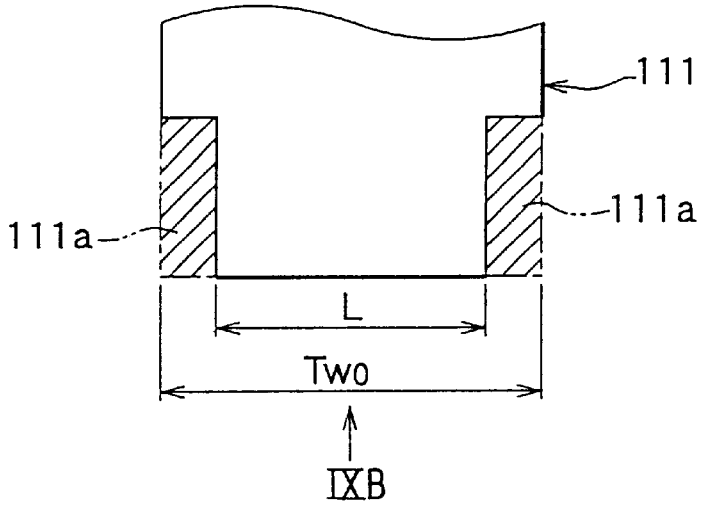
FIG. 9A is a front view showing a longitudinal direction end portion of a tube in a second preferred embodiment.
Figure 9B:
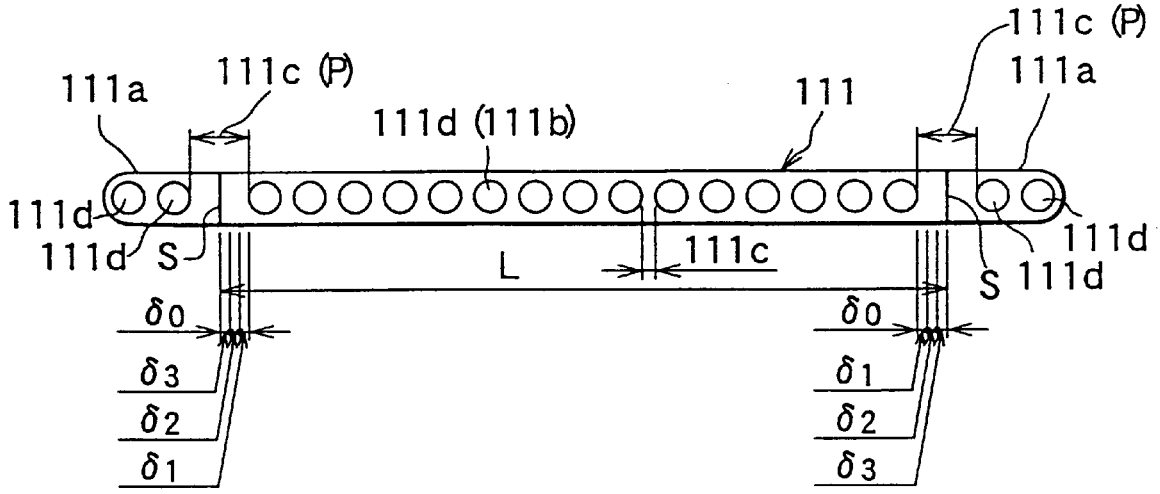
FIG. 9B is a plan view showing the longitudinal direction end portion of the tube, in a direction indicated by arrow IXB in FIG. 9A.

In the first embodiment, the tube 111 has no hole extending in the longitudinal direction of the tube 111, at the cross-sectional long side ends with respect to the cut surfaces S. In a second preferred embodiment, as shown in FIG. 9A, holes 111*b* arranged in the cross-sectional long side direction of the tube 111 include holes provided at the cross-sectional long side ends with respect to the cut surfaces S. In this case, as shown in FIG. 9B, a pitch 111*c* of the passage holes 111*b* is increased to a pitch P at portions corresponding to the cut surfaces S as compared to the other portions. More specifically, a half of the pitch P is larger than the pitch 111*c*, so that the distance of one of the passage holes 111*b*, which is provided most adjacently to one of the cut surfaces S from the one of the cut surfaces S is set to be larger than the pitch 111*c*. In this embodiment, only the holes 111*b* provided between the cut surfaces S function as passage holes in which refrigerant flows.

Figure 10A:
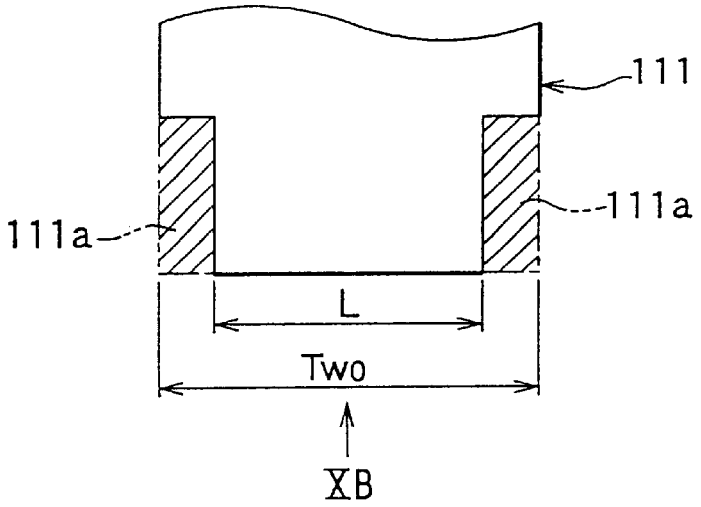
FIG. 10A is a front view showing a longitudinal direction end portion of a modified tube in the second embodiment.
Figure 10B:
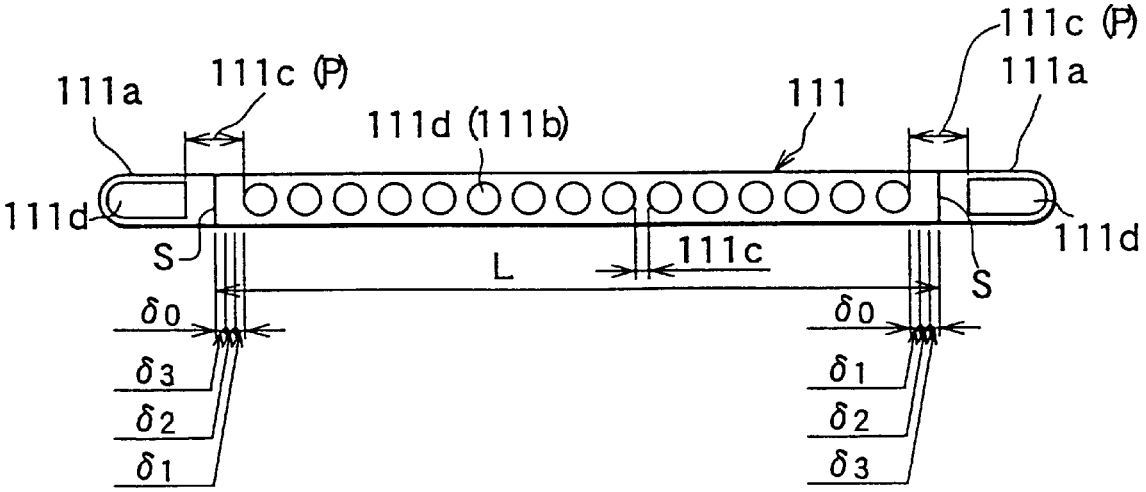
FIG. 10B is a plan view showing the longitudinal direction end portion of the tube in a direction indicated by arrow XB in FIG. 10A.

In the tube 111 according to the present embodiment, any of the holes 111*b* are not provided in the vicinity of the cut surfaces S. Therefore,the cut surfaces S are prevented from being sagged or deformed when the cross-sectional long side end portions of the tube 111 are removed by cutting. Incidentally, as shown in FIGS. 10A and 10B, each shape of the holes 111*b* provided at the cross-sectional long side ends with respect to the cut surfaces S is not limited to a circular shape, but may be other shapes.

(Third Embodiment)

Figure 11A:
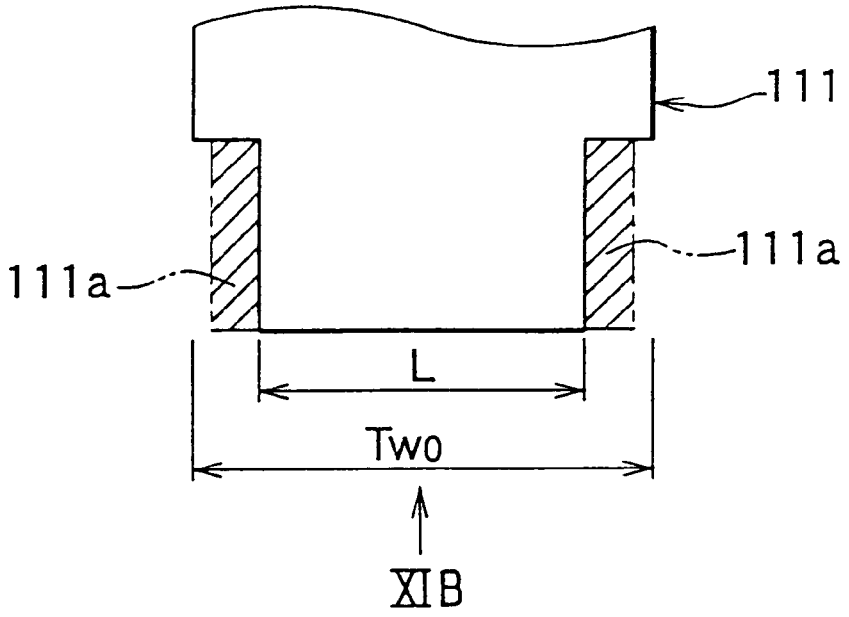
FIG. 11A is a front view showing a longitudinal direction end portion of a tube in a third preferred embodiment.
Figure 11B:
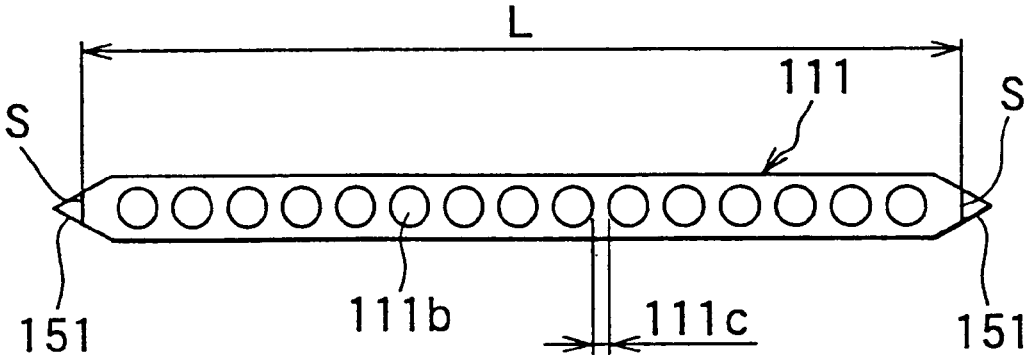
FIG. 11B is a plan view showing the longitudinal direction end portion of the tube in a direction indicated by arrow XIB in FIG. 11A.

In the first embodiment, the cut surface S is provided between the passage holes 111*b* and the tapered portion 151. However, as shown in FIGS. 11A and 11B, the cut surface S may be provide by cutting a part of the tapered portion 151 in a thickness direction of the tube 111. Accordingly, a cut length of the cut surface S can be decreased, resulting in decrease in man-hour of the step for forming the notch portions 111*a*. This further results in decreased manufacture cost of the tube 111. Here the cut length of the cut surface S is a dimension of the cut surface S in the thickness direction of the tube 111.

In the embodiments described above, the present invention is applied to the evaporator, but is not limited to that. The present invention can be applied to other heat exchangers such as a radiator for a super critical refrigerating cycle and a condenser for a refrigerating cycle. The tubes 111 may be disposed to extend in a horizontal direction. Also, in the embodiments described above, although the tube width $T_{W0}$ is set to be less than the outer wall width $T_{W2}$ of the header 120, the tube width $T_{W0}$ may be set to be larger than the outer wall width $T_{W2}$ of the header 120.

Figure 12A:
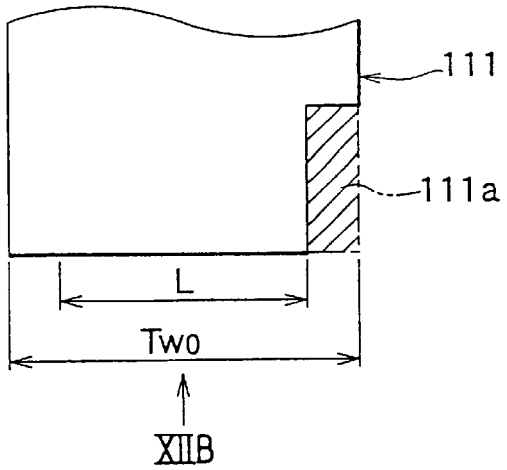
FIG. 12A is a front view showing a longitudinal direction end portion of a tube in a modified embodiment of the present invention.
Figure 12B:
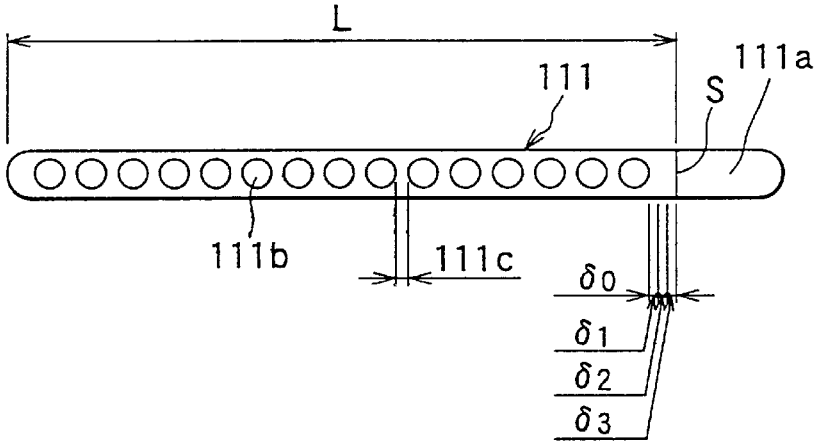
FIG. 12B is a plan view showing the longitudinal direction end portion of the tube in a direction indicated by arrow XIIB in FIG. 12A.
Figure 13:
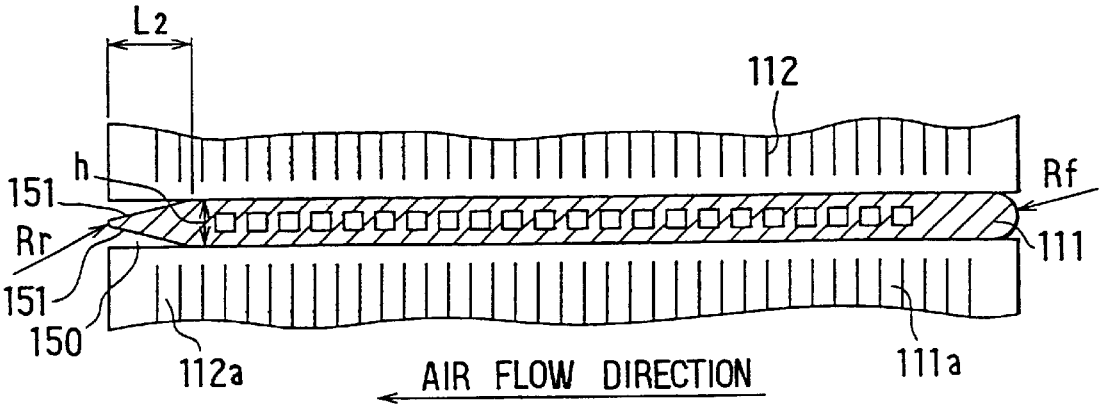
FIG. 13 is a cross-sectional view showing a core portion of a heat exchanger in another modified embodiment of the present invention.

In the third embodiment, although the tapered portions 151 are formed at the both ends in the cross-sectional long side direction of the tube 111, the tapered portions 151 may be formed at only one of the ends of the tube 111. In the embodiments described above, the notch portions 111*a* are provided at the both ends in the cross-sectional long side direction of the tube 111. However, as shown in FIGS. 12A and 12B, the notch portion 111*a* may be provided at only one of the ends of the tube 111. The shape of each passage hole 111*b* is not limited to a circle in cross section, but may be other shapes such as a rectangle shown in FIG. 13, a polygon, or an elliptic shape.

Figure 14A:
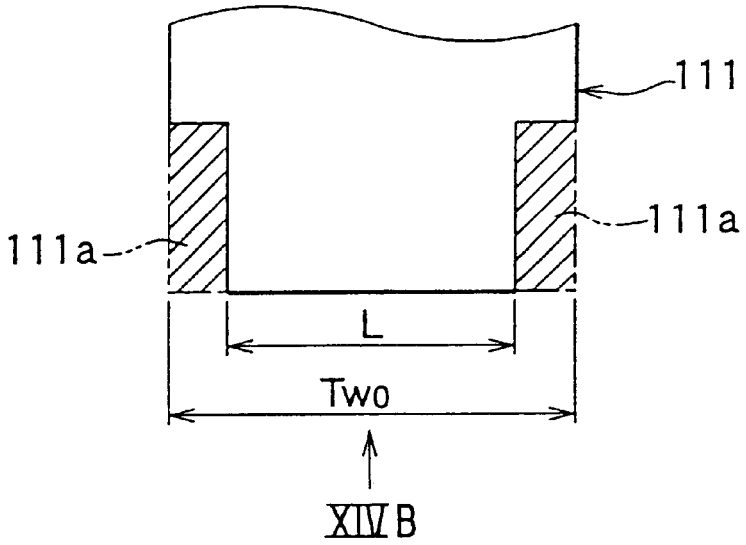
FIG. 14A is a front view showing a longitudinal direction end portion of a tube in another modified embodiment of the present invention.
Figure 14B:
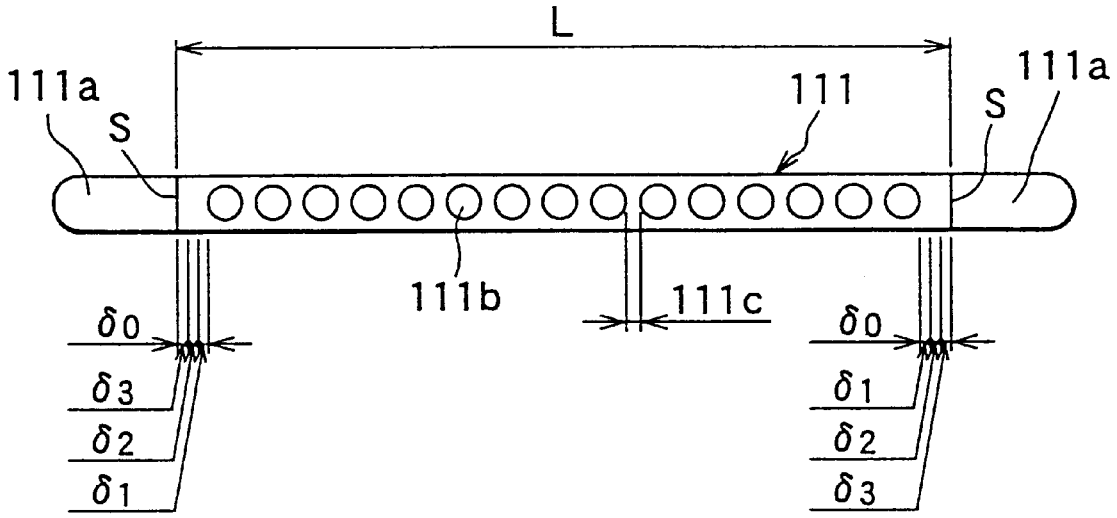
FIG. 14B is a plan view showing the longitudinal direction end portion of the tube in a direction indicated by arrow XIVB in FIG. 14A.
Figure 15A:
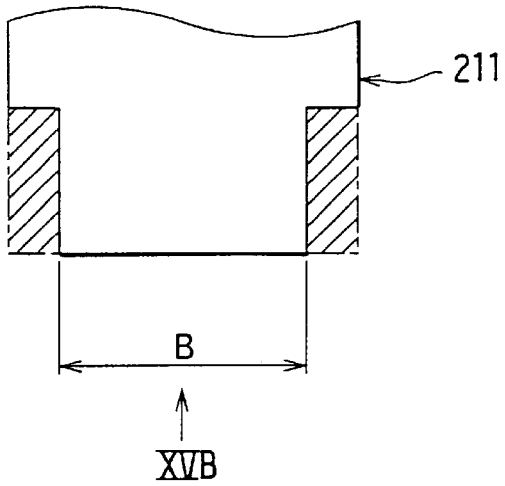
FIG. 15A PRIOR ART
FIG. 15A is a front view showing a longitudinal direction end portion of a tube according to a prior art.
Figure 15B:
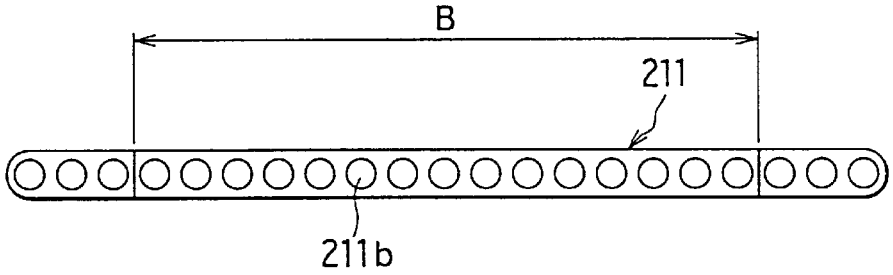
FIG. 15B PRIOR ART
FIG. 15B is a plan view showing the longitudinal direction end portion of the tube in a direction indicated by arrow XVB in FIG. 15A.
Figure 16A:
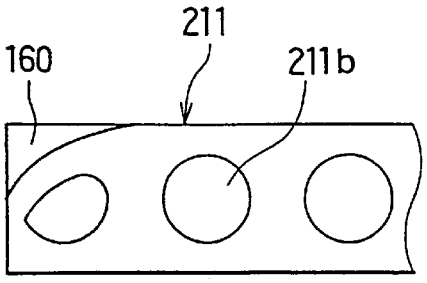
FIGS. 16A and 16B are enlarged cross-sectional views partially showing a tube for explaining conventional problems.
Figure 16B:
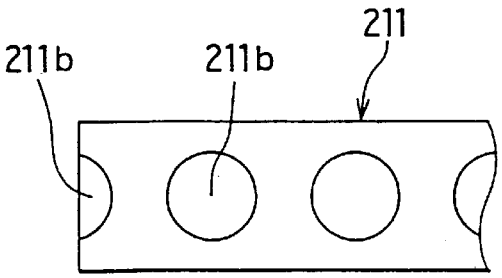

In the first and second embodiments, the tapered portion (s) 151 is formed at the cross-sectional long side end(s) of the tube 111. However, as shown in FIGS. 14A and 14B, the tube 111 can dispense with the tapered portion 151. Further, as shown in FIG. 7, the tapered surface of the tapered portion 151 is flat and extends linearly in cross section in the first and third embodiments. However, the tapered surface may be curved in cross section. It is apparent that one of the embodiments described above can be combined with another one of the embodiments appropriately.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A heat exchanger comprising:

a flat tube having an end portion in a longitudinal direction thereof, the end portion having an end portion width smaller than a tube width which is a width of the tube at a portion other than the end portion, the end portion width and the tube width being perpendicular to the longitudinal direction and parallel to a cross-sectional long side direction of the tube, the tube defining therein a plurality of passage holes in which a first fluid flows, the plurality of passage holes being arranged in the cross-sectional long side direction within the end portion width to open at the end portion;

a fin joined to the tube to facilitate heat exchange between the first fluid flowing inside the tube and a second fluid flowing outside the tube; and a tank connected to the end portion of the tube to communicate with the plurality of passage holes, wherein:

the end portion is formed by a cut surface which extends in the longitudinal direction and determines the end portion width;

the plurality of passage holes include a hole disposed most adjacently to the cut surface and defining a specific distance $\delta_0$ from the cut surface to be prevented from being crushed when the cut surface is formed.

2. The heat exchanger of claim 1, wherein the specific distance $\delta_0$ is represented by a formula of:

$$\delta_0=\delta_1+\delta_2+\delta_3,$$

in which $\delta_1$ is a dimension required for preventing the hole from being crushed when the cut surface is formed;

$\delta_2$ is a dimensional tolerance between the plurality of passage holes; and $\delta_3$ is a positional cut tolerance of the cut surface.

3. The heat exchanger of claim 1, wherein:

the tank has an inner wall width and an outer wall width respectively defined by an inner wall and an outer wall of the tank and parallel to the cross-sectional long side direction of the tube; and the inner wall width is larger than the end portion width and is smaller than the tube width.

4. The heat exchanger of claim 1, wherein:

the plurality of passage holes are arranged in the cross-sectional long side direction of the tube with a pitch; and the specific distance between the hole and the cut surface is larger than the pitch.

5. The heat exchanger of claim 1, wherein:

the tube has an upstream side end portion and a downstream side end portion in the cross-sectional long side direction in which the second fluid flows from the upstream side end to the downstream side end; and the downstream side end portion defines a gap with the fin, the gap having a length parallel to the cross-sectional long side direction and larger than a half of a thickness in a cross-sectional short side direction of the tube.

6. The heat exchanger of claim 1, wherein:

the tube has an upstream side end portion and a downstream side end portion in the cross-sectional long side direction in which the second fluid flows from the upstream side end to the downstream side end; and the downstream side end portion is tapered so that a thickness of the downstream side end portion in a cross-sectional short side direction of the tube is decreased toward a front tip thereof.

7. The heat exchanger of claim 6, wherein the cut surface is formed by cutting a part of the tapered downstream side end portion.

8. The heat exchanger of claim 1, wherein:

the tank has an insertion hole; and the end portion of the tube is inserted into the insertion hole.

9. The heat exchanger of claim 1, wherein the cut surface includes first and second cut surfaces respectively provided at both ends of the end portion in the cross-sectional long side direction to define the end portion width therebetween.

10. A heat exchanger comprising:

a flat tube having an end portion in a longitudinal direction thereof, the end portion having an end portion width smaller than a tube width, which is a width of the tube at a portion other than the end portion, the end portion width and the tube width being perpendicular to the longitudinal direction and parallel to a cross-sectional long side direction of the tube, the tube having therein a plurality of passage holes in which a first fluid flows, the plurality of passage holes being arranged in the cross-sectional long side direction to respectively extend in the longitudinal direction of the tube;

a fin joined to the tube to facilitate heat exchange between the first fluid flowing inside the tube and a second fluid flowing outside the tube; and a tank connected to the end portion of the tube to communicate with the plurality of passage holes, wherein:

the end portion is formed by a cut surface which extends approximately in the longitudinal direction between first and second passage holes of the plurality of passage holes and determines the end portion width; and a pitch of the first and second passage holes is larger than a pitch of the plurality of passage holes other than the first and second passage holes.

11. The heat exchanger of claim 10, wherein:

the tank has an inner wall width and an outer wall width respectively defined by an inner wall and an outer wall of the tank and parallel to the cross-sectional long side direction of the tube; and the inner wall width is larger than the end portion width and is smaller than the tube width.

12. The heat exchanger of claim 10, wherein:

the tube has an upstream side end portion and a downstream side end portion in the cross-sectional long side direction in which the second fluid flows from the upstream side end to the downstream side end; and the downstream side end portion defines a gap with the fin, the gap having a length parallel to the cross-sectional long side direction and larger than a half of a thickness in a cross-sectional short side direction of the tube.

13. The heat exchanger of claim 10, wherein:

the tube has an upstream side end portion and a downstream side end portion in the cross-sectional long side direction in which the second fluid flows from the upstream side end to the downstream side end; and the downstream side end portion is tapered so that a thickness of the downstream side end portion in a cross-sectional short side direction of the tube is decreased toward a front tip thereof.

14. The heat exchanger of claim 13, wherein the cut surface is formed by cutting a part of the tapered downstream side end portion.

15. The heat exchanger of claim 10, wherein:

the tank has a insertion hole; and the end portion of the tube is inserted into the insertion hole.

16. The heat exchanger of claim 10, wherein the cut surface includes first and second cut surfaces respectively provided at both ends of the end portion in the cross-sectional long side direction to define the end portion width therebetween.

17. A heat exchanger comprising:

a flat tube having a longitudinal side end portion in a longitudinal direction thereof, the longitudinal side end portion having an end portion width smaller than a tube width at a portion of the tube other than the end portion, the end portion width and the tube width being perpendicular to the longitudinal direction and parallel to a cross-sectional long side direction of the tube, the tube defining therein a plurality of passage holes in which a first fluid flows, the plurality of passage holes being arranged in the cross-sectional long side direction;

a fin joined to the tube to facilitate heat exchange between the first fluid flowing inside the tube and a second fluid flowing outside the tube; and a tank connected to the longitudinal side end portion of the tube to communicate with the plurality of passage holes, wherein:

the tube has an upstream side end portion and a downstream side end portion in the cross-sectional long side direction in which the second fluid flows from the upstream side end to the downstream side end, the downstream side end portion being tapered so that a thickness of the downstream side end portion in a cross-sectional short side direction of the tube is decreased toward a front tip thereof; and the longitudinal side end portion of the tube is formed by a cut surface which is formed by cutting a part of the tapered downstream side end portion to extend in the longitudinal direction.

18. The heat exchanger of claim 7, wherein the plurality of passage holes are arranged within the end portion width to always extend in and open at the longitudinal end portion.

19. A heat exchanger comprising:

a tube having a notch portion at an end in a longitudinal direction of the tube to have an longitudinal end portion, the longitudinal end portion being defined by a cut surface of the notch portion to have an end portion width perpendicular to the longitudinal direction, the end portion width being smaller than a tube width of a portion other than the end portion in the tube;

a fin joined to the tube to facilitate heat exchange between a first fluid flowing inside the tube and a second fluid flowing outside the tube; and a tank connected to the longitudinal end portion of the tube, wherein:

the tube has a plurality of passage holes arranged in a direction parallel to the end portion width with a pitch, each of the plurality of passage holes communicating with the tank and extending in the tube in the longitudinal direction; and the plurality of passage holes includes a hole which is disposed most adjacently to the cut surface with a specific distance from the cut surface, the specific distance being larger than the pitch.

20. The heat exchanger of claim 19, wherein all of the plurality of passage holes extend in and open at the longitudinal end portion to communicate with the tank.

* * * * *